United States Patent [19]

Shum

[11] 4,182,412

[45] Jan. 8, 1980

[54] FINNED HEAT TRANSFER TUBE WITH POROUS BOILING SURFACE AND METHOD FOR PRODUCING SAME

[75] Inventor: Ming S. Shum, Des Plaines, Ill.

[73] Assignee: UOP Inc., Des Plaines, Ill.

[21] Appl. No.: 867,856

[22] Filed: Jan. 9, 1978

[51] Int. Cl.[2] ..... F28F 13/18

[52] U.S. Cl. ..... 165/133; 165/DIG. 8; 62/527

[58] Field of Search ..... 165/133, 180, DIG. 8, 165/185; 62/527

[56] References Cited

U.S. PATENT DOCUMENTS

| | | | |
|---|---|---|---|
| 1,879,140 | 9/1932 | Edwards | 165/133 |
| 2,368,403 | 1/1945 | Barnes | 165/180 |
| 2,455,457 | 12/1948 | Whitfield et al. | 165/133 |
| 2,713,997 | 7/1955 | Ruckstell | 165/133 |
| 3,884,772 | 5/1975 | Shiga | 204/16 |
| 4,120,994 | 10/1978 | Inoue | 165/133 |

FOREIGN PATENT DOCUMENTS

| | | | |
|---|---|---|---|
| 1375160 | 11/1974 | United Kingdom | 165/133 |

*Primary Examiner*—Sheldon Jay Richter

*Attorney, Agent, or Firm*—James R. Hoatson, Jr.; Barry L. Clark; William H. Page, II

[57] ABSTRACT

The invention relates to finned heat transfer tubes and to a method for impoving the heat transfer properties in boiling liquids of such tubes by plating the tubes in an electroplating bath containing conductive particles such as graphite powder to produce a porous plated surface. The tips of the fins are covered before plating with a non-conductive coating to prevent plating of the tips. The non-conductive coating can be dissolved away or mechanically removed after plating.

6 Claims, 3 Drawing Figures

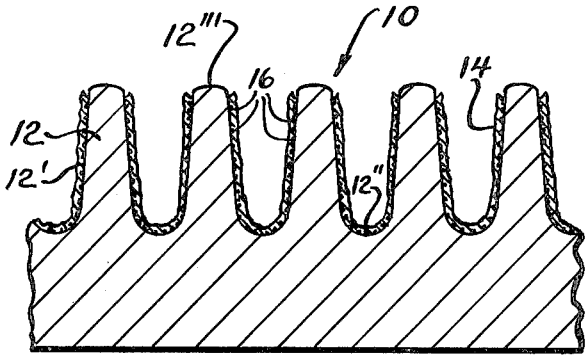
Fig. 1
Fig. 3
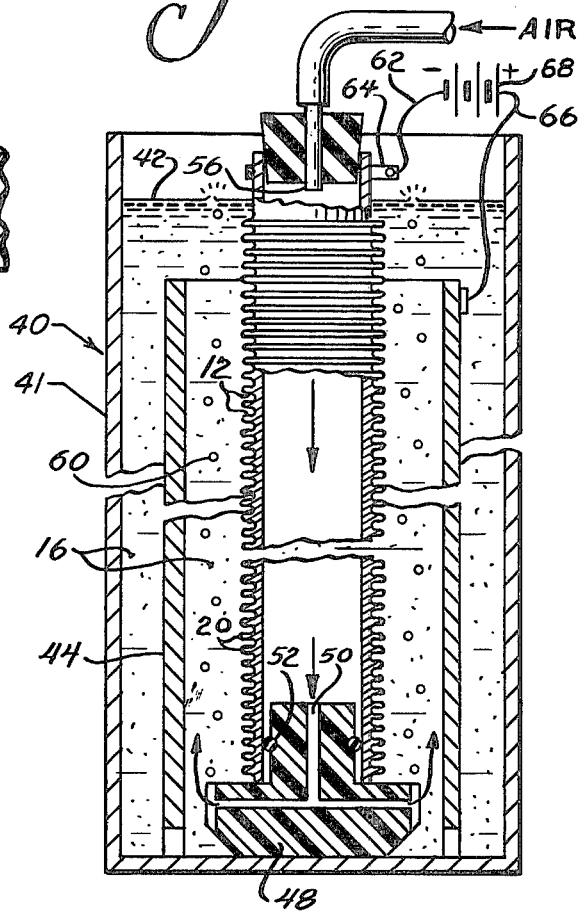
Fig. 2
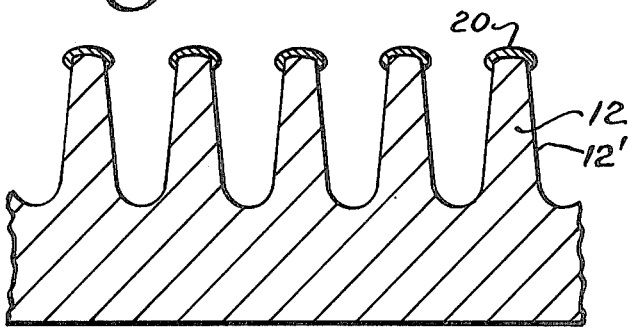

FINNED HEAT TRANSFER TUBE WITH POROUS BOILING SURFACE AND METHOD FOR PRODUCING SAME

SUMMARY

It is among the objects of the present invention to provide an improved heat transfer surface on a finned tube and a method of making same which will produce a very high density of nucleation sites at a relatively low cost and without affecting the properties of the base tube.

The improved tube is produced by placing the finned tube to be plated, usually copper, in a container of plating solution, usually copper sulfate; adding a small quantity of finely powdered graphite such as Formula 8485 sold by The Joseph Dixon Crucible Co. of Jersey City, N.J., or Grade No. 38 sold by Union Carbide; agitating the solution with air to keep the graphite in suspension; and electrically connecting the finned tube to be plated to a source of direct current and to a source of metal to cause the graphite to be attracted to the conductive fin surfaces to which it will be plated so as to produce an irregular porous surface. The peripheral tip portions of the fins are insulated by a coating of paint or other suitably adherent material prior to plating to prevent plating from taking place thereon. Although the tip coating covers such a small area relative to the total fin surface area that its presence on the finished tube would have negligible effect on heat transfer, it is preferably removed in any suitable manner such as by solvents, pyrolysis, mechanically such as by grinding, or by other means so that it cannot flake off during use and contaminate the heat transfer fluid. Without the insulating coating on the fin tips during plating, the plating would tend to build up in a rather useless fashion on the tips rather than on the flat side surfaces of the fins since the tips are quite close to the tubular anode which surrounds the tube and supplies the copper to be plated. Plating at the tips would be useless since very little heat can be transferred at the tips. More importantly, the tendency of the plating to take place to the closest point to the anode would result in very little plating of the sides and roots of the fins. Furthermore, the plating of the unprotected tips would probably build up so quickly that the fin spaces would be closed and thus unavailable for nucleate boiling.

The purpose of the graphite particles is to produce a rough plated surface which will provide a very large number of nucleation sites. Preferably, the graphite particles are no larger than about 200 mesh. Since the particles are conductive, the plating current will cause them first to be attracted to the exposed fin surfaces and then to be plated to each other and the fins. In the resultant product, the graphite particles are coated with the metal plating and thus, do not have to be removed from the finished product.

BRIEF DESCRIPTION OF THE DRAWINGS

FIG. 1 is an enlarged fragmentary axial cross-section of a tube made in accordance with the invention;

FIG. 2 is a view similar to FIG. 1 which shows the finned tube after its tips are coated but before it is plated; and FIG. 3 is a side sectional view showing an apparatus for electroplating the finned tube of FIG. 2.

DESCRIPTION OF THE PREFERRED EMBODIMENT

Referring to FIG. 1, a fragmentary enlarged cross-section of a tube made in accordance with my invention is illustrated. The tube, indicated generally at 10, has a plurality of fins 12 having side surfaces 12', root portions 12'' and tip portions 12'''. The tip portions 12''' are preferably uncoated while the side and root portions 12' and 12'' are plated with a plating 14 of metal so as to provide a rough texture. The rough texture is caused by the inclusion in the plated coating of tiny conductive particles such as graphite particles 16, preferably of a size less than 200 mesh. Many of the graphite particles 16 are in contact with the tube surfaces 12' and 12'' and are completely encapsulated by the plating layer 14 except for the tiny areas of contact with the tube surfaces. The plating layer 14 is integrally attached to the tube surfaces except for the small area thereof where the graphite particles make contact. The graphite particles 16 are conductive and are attracted toward the tube surfaces 12', 12'' when the tube 10 is plated. Thus, the plating 14 will coat the graphite particles 16 and build up on the tube surface areas between them. By varying the particle size and amount of graphite present during plating as well as the plating current and time, it is possible to vary the characteristics of the plated coating 14.

In making an experimental tube, 15 g of Union Carbide Grade 38 graphite powder was placed in a standard $CuSO_4$ plating solution in which an 8 foot copper tube having 20 f.p.i. was suspended. Plating was carried on for 3 hours at a current of 10 amperes per foot, resulting in the plating application of approximately 36 g. per foot of copper to the tube. A boiling test comparison in Freon R-11 of a one foot section of my improved plated tube and a similar length of unplated finned tubing heated internally with varying amounts of heat showed substantial improvement for the plated tube as evidenced by lower internal wall temperature readings. For example, when 150 watts of heating was supplied, the unplated fin tube had an internal wall temperature (as measured by a thermocouple) of 44° C. while the plated fin tube had a temperature of 33° C. Similarly, for 100 watts of heating, the respective temperatures were 38° C. and 30° C. For 50 watts of heating the respective temperatures were 32° C. and 27° C. and for 10 watts of heating, the respective temperatures were 26° C. and 24° C.

The plating may be carried out in an apparatus such as that indicated generally at 40 in FIG. 3. The apparatus 40 comprises a vertical tank 41 filled with plating solution 42 and containing a tubular anode 44 of copper which is the source of the metal to be plated to the tube fins 12. The tube is prepared as shown in FIG. 2 before it is plated so that the fins 12 are coated with an insulating coating 20. The coating can be applied in any suitable manner including rolling the tube on a porous surface coated with the coating material. The tube preferably rests on an insulating block 48 of plastic or other suitable material. The block 48 has internal passageways 50 and is seated to the tube by an O-ring seal 52. A rubber stopper member containing an inlet air tube 56 is pressed into the top of the finned tube. Air is injected into the air tube 56 and then passes outwardly through the passages 50 where it forms air bubbles 60 which agitate the plating solution 42 and help keep the graphite particles 16 in suspension. A lead wire 62 connected to a contact ring 64 on the finned tube and a lead wire 66 connected to the anode 44 are also each connected to a battery or other power supply 68 to complete the electrical circuit necessary for plating to take place. Before the power supply is connected, the graphite particles 16 should be placed in the plating solution 42 and agitated into suspension therein by the air bubbles 60. Thus, when the power supply is connected, the conductive graphite particles 16 will be immediately electrically attracted to all the portions of the fins 12 which are not insulated by the coating 20. The plating will then build up on and around the particles 16 and on the exposed surfaces of fins 12 which are not contacted by particles 16. As previously discussed, the coating 20 may be removed after plating coat 14 is applied so that the fin tube 10 will have the cross-sectional configuration shown in FIG. 1.

I claim as my invention:

1. A metal finned tube having an improved boiling surface comprising a coating including an electroplated metal portion, said coating being on the side surface portions and root portions of its fins but with the metallic tip portions of its fins being devoid of said coating, the coating including a large number of powder-like conductive particles which are either completely encapsulated by the electroplated metal portion or completely encapsulated except for a point of contact between said conductive particles and the metal surface of the fins or tube, said conductive particles causing said coating to be textured.

2. The finned tube of claim 1 wherein said conductive particles are graphite.

3. The finned tube of claim 2 wherein said graphite particles have a size no greater than 200 mesh.

4. The finned tube of claim 1 wherein said tube and plated coating comprise copper.

5. The finned tube of claim 1 wherein said plating has a density of about 36 g. per foot of length.

6. The finned tube of claim 1 wherein said tube has approximately 20 fins per inch of length.

* * * * *